US008443488B2

(12) United States Patent
Zhang

(10) Patent No.: US 8,443,488 B2
(45) Date of Patent: May 21, 2013

(54) DOOR CLOSER CAPABLE OF REALIZING SELF-CONTROL POSITIONING

(75) Inventor: Gongchun Zhang, Guangzhou (CN)

(73) Assignee: Cmech (Guangzhou) Industrial Ltd. (CN)

( * ) Notice: Subject to any disclaimer, the term of this patent is extended or adjusted under 35 U.S.C. 154(b) by 76 days.

(21) Appl. No.: 13/166,198

(22) Filed: Jun. 22, 2011

(65) Prior Publication Data

US 2012/0167340 A1 Jul. 5, 2012

(30) Foreign Application Priority Data

Jan. 4, 2011 (CN) ..... 2011 1 0000407

(51) Int. Cl.
*E05F 3/00* (2006.01)
*E05F 3/02* (2006.01)

(52) U.S. Cl.
USPC ..... 16/65; 16/66

(58) Field of Classification Search
USPC ..... 16/66, 65, 71, 72, 49, 80, 61; 292/306, 292/262, 278, 266–268, 305
See application file for complete search history.

(56) References Cited

U.S. PATENT DOCUMENTS

| | | | | |
|---|---|---|---|---|
| 2,423,118 | A * | 7/1947 | Ramsay | 451/324 |
| 2,732,920 | A * | 1/1956 | Newton | 16/48.5 |
| 4,382,311 | A * | 5/1983 | Watts | 16/66 |
| 4,639,969 | A * | 2/1987 | Obenshain | 16/70 |
| 4,813,163 | A * | 3/1989 | Livingston et al. | 37/444 |
| 4,894,883 | A * | 1/1990 | Fleischhauer | 16/66 |
| 5,529,148 | A * | 6/1996 | O'Leary | 188/67 |
| 5,630,248 | A * | 5/1997 | Luca | 16/71 |
| 5,832,562 | A * | 11/1998 | Luca | 16/71 |
| 6,615,449 | B1 * | 9/2003 | Alvarez | 16/66 |
| 7,134,168 | B1 * | 11/2006 | Qing | 16/80 |
| 2003/0226235 | A1 * | 12/2003 | Hodson | 16/66 |

FOREIGN PATENT DOCUMENTS

| | | |
|---|---|---|
| CN | 2545322 | 4/2003 |
| CN | 201424887 | 3/2010 |
| CN | 201554315 | 8/2010 |
| WO | WO 9612077 A1 * | 4/1996 |

* cited by examiner

*Primary Examiner* — Chuck Y. Mah
(74) *Attorney, Agent, or Firm* — Schmeiser, Olsen & Watts, LLP

(57) ABSTRACT

A door closer capable of realizing self-control positioning has a cylindrical housing, a piston, a spring and a pull rod; the piston is built in the cylindrical housing and connected and fastened with one end of the pull rod; the pull rod is sheathed in the spring, and the two end parts of the spring respectively are in contact with a sealing lid of the piston and the cylindrical housing; the door closer further has a self-control positioning mechanism having a cylindrical outer sleeve a control part and a locking part; the cylindrical outer sleeve is connected and fastened with the cylindrical housing; the control part and the locking part are linked by a clutch and joined together; the locking part and the pull rod are linked by a clutch, and the pull rod is provided with a series of grooves which can be clasped with the locking part.

6 Claims, 6 Drawing Sheets

DOOR CLOSER CAPABLE OF REALIZING SELF-CONTROL POSITIONING

TECHNICAL FIELD

The invention relates to a door closer which belongs to the technical field of the door closers, in particular to a door closer capable of realizing self-control positioning.

BACKGROUND OF THE INVENTION

At present, door closers are ordinarily adopted in safety doors, anti-theft doors, room doors, toilet doors, kitchen doors, screen window doors, cabinet doors or windows and the like for realizing the automatic closing function, thereby realizing effective fireproof and anti-theft effect. In the prior art, the types of the door closers can be mechanical type, pneumatic type and hydraulic type generally, wherein the mechanical door closers generally adopt springs for constituting elastic components, when an operator pushes a door leaf, the spring is driven to accumulate energy by stretching, compression or torsion and other deformation, when the operator leaves the door leaf, the status of the spring is changed from energy accumulation to energy release, and a pull rod can close a door under the drive of the spring. But, the mechanical door closers in the prior art have one problem during the using process, that is the door closer can only fix a position of the door leaf when the opening angle of the door leaf exceeds 90 degrees, otherwise, the door closer can automatically drive the door leaf to close, so that the use is not convenient enough sometimes.

SUMMARY OF THE INVENTION

The invention aims at overcoming the shortcomings and the deficiencies in the prior art and providing a door closer capable of realizing self-control positioning, which is reasonable and compact in structure, convenient and easy for operation, practical and reliable.

In order to realize the purposes, the invention is realized through the following technical scheme: A door closer capable of realizing self-control positioning comprises an elastic mechanism, wherein the elastic mechanism comprises a cylindrical housing, a piston component, a long spring and a pull rod, the piston component is built in the cylindrical housing and connected and fastened with one end of the pull rod, the pull rod is sheathed in the long spring, and two end parts of the long spring respectively are in contact with a sealing lid of the piston component and the cylindrical housing; and the door closer further comprises a self-control positioning mechanism, the self-control positioning mechanism comprises a cylindrical outer sleeve, a control part and a locking part, the cylindrical outer sleeve is connected and fastened with the cylindrical housing, the control part is engaged and disengaged with the locking part, and the locking part is engaged and disengaged with the pull rod, and the pull rod is provided with a series of grooves any one of which is clasped with the locking part.

Further, the pull rod is in a square structure, the other end of the pull rod, which is opposite to another end fastened the piston component, penetrates the cylindrical outer sleeve and extends out of the end part of the cylindrical outer sleeve, the series of grooves is arranged on a top surface of the pull rod, one side wall of each groove is a vertical plane, and the opposite side wall thereof is an inclined plane.

Further, the control part comprises a rotary control handle, a locking switch and an elastic latch component, wherein the rotary control handle is arranged outside the cylindrical outer sleeve; the locking switch is connected and joined with the rotary control handle to form a connection part and in rotating connection with the cylindrical outer sleeve through a movable pin, a pressing-down convex is arranged at the lower end of the locking switch, the lower is near to the connection part, a pressing-down locking block is arranged at one end which is farther away from the connection part, and a circular arc-shaped bulge is arranged on the outer end side of the pressing-down locking block; and the elastic latch component comprises a latch spring and an elastic latch bar, the latch spring is arranged in a chamber positioned at the upper end of the cylindrical outer sleeve, one end of the elastic latch bar pushes against and is in contact with the latch spring, and the other end of the elastic latch bar extends out of the chamber and is contacted in sliding fit with the circular arc-shaped bulge of the pressing-down locking block of the locking switch.

Further, the locking part is built in the cylindrical outer sleeve and comprises connecting side plates and a movable lock core, wherein the connecting side plates comprise a left connecting side plate, a right connecting side plate, a front connecting side plate and a rear connecting side plate, the connecting side plates are mutually connected for forming a frame-shaped structure, the left connecting side plate and the right connecting side plate are correspondingly provided with special-shaped inclined holes, the front connecting side plate and the rear connecting side plate are correspondingly provided with square holes for enabling the pull rod to penetrate, an extended block is arranged at the upper end of the front connecting side plate, and a guide wedge block is arranged at the upper end of the rear connecting side plate; and the movable lock core is engaged and disengaged with the locking switch, the movable lock core is arranged in the frame-shaped structure of the connecting side plates and connected in sliding fit with the special-shaped inclined holes of the left connecting side plate and the right connecting side plate through a movable bolt, two ends of the movable bolt are respectively connected and matched with tension springs positioned at the left connecting side plate and the right connecting side plate, and a clasp is arranged at the lower end of the movable lock core, which is clasped with any one of the series of grooves on the pull rod when locking.

Further, the movable lock core pushes against the extended block when the pull rod is in a locking state, and pushes against the guide wedge block when the pull rod is in a free state. Further, the movable lock core is formed by connecting and fastening a plurality of sheets, and each sheet is respectively provided with the clasp which is clasped with any one of the series of grooves on the pull rod when locking.

Further, the locking part comprises a positioning support, and the positioning support is respectively fixed in plug-in manner with the left connecting side plate and the right connecting side plate.

Compared with the prior art, the invention has the following benefits:

1) the pull rod can be limited and positioned at any angle through the self-control positioning mechanism, thereby ensuring that a door leaf can be positioned arbitrarily and facilitating personnel circulation or cargo transportation and the like; and 2) the overall structure is reasonable and compact, the operation is convenient and easy, and the door closer is safe, practical and reliable, and further applicable to popularization and use in different occasions.

In order to understand the invention more clearly, in combination of the figures, the invention is further described through the following embodiments.

DETAILED DESCRIPTION OF THE INVENTION

Figure 1:
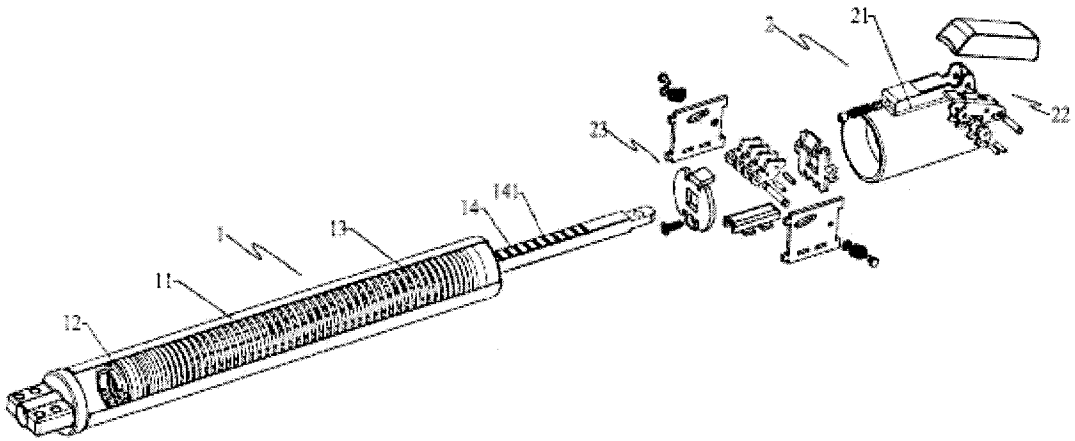
FIG. 1 is a exploded diagram of the invention.
Figure 2:
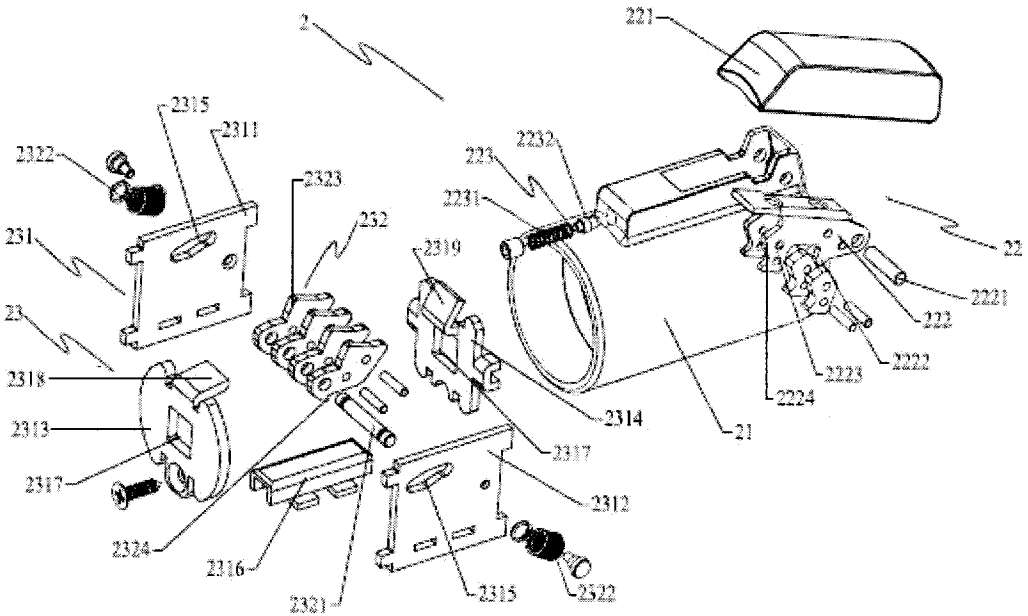
FIG. 2 is an amplified schematic diagram of self-control positioning mechanism in FIG. 1.
Figure 3:
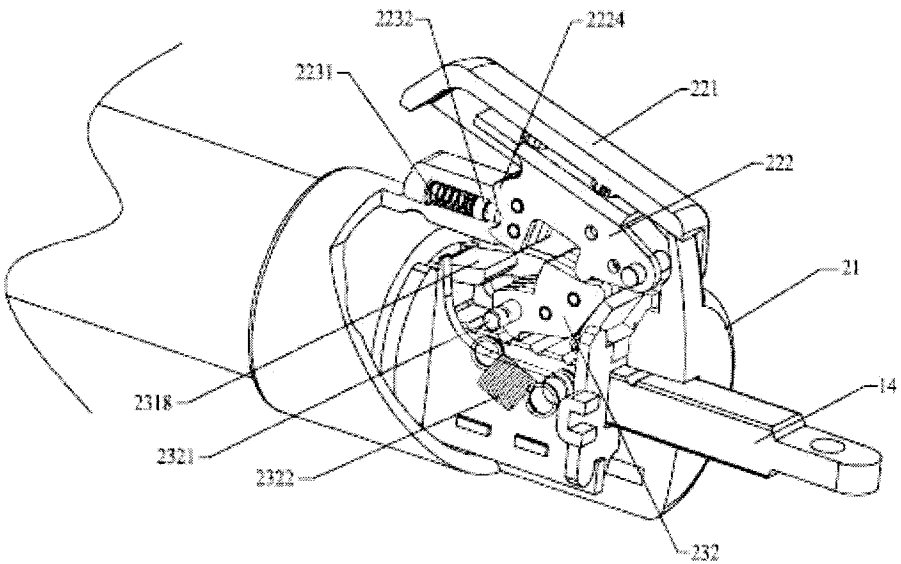
FIG. 3 is an assembly schematic diagram of self-control positioning mechanism in FIG. 1.

As shown in FIG. 1 to FIG. 3, a door closer capable of realizing self-control positioning of the invention comprises an elastic mechanism 1 and a self-control positioning mechanism 2.

The elastic mechanism 1 comprises a cylindrical housing 11, a piston component 12, a long spring 13 and a pull rod 14, wherein the piston component 12 is built in the cylindrical housing 11 and connected and fastened with one end of the pull rod 14, the pull rod 14 is sheathed in the long spring 13, two end parts of the long spring 13 respectively are in contact with a sealing lid of the piston component 12 and the cylindrical housing 14, the pull rod 14 is in a square structure, a series of grooves is arranged on a top surface of the pull rod 14, one side wall of each groove 141 is a vertical plane, and the opposite side wall thereof is an inclined plane.

The self-control positioning mechanism 2 comprises a cylindrical outer sleeve 21, a control part 22 and a locking part 23, the cylindrical outer sleeve 21 is connected and fastened with the cylindrical housing 11, the control part 22 is engaged and disengaged with the locking part 23, and the locking part 23 is engaged and disengaged with the pull rod 14.

Further, the control part 22 comprises a rotary control handle 221, a locking switch 222 and an elastic clamping component 223, wherein the rotary control handle 221 is arranged outside the cylindrical outer sleeve 21; the locking switch 222 is connected and joined with the rotary control handle 221 to form a connection part and in rotating connection with the cylindrical outer sleeve 21 through a movable pin 2221, a pressing-down convex 2222 is arranged at the lower end of the locking switch, the lower end is near to the connection part, a pressing-down locking block 2223 is arranged at one end which is farther away from the connection part, and a circular arc-shaped bulge 2224 is arranged on the outer end side of the pressing-down locking block 2223; and the elastic latch component 223 comprises a latch spring 2231 and an elastic latch bar 2232, the latch spring 2231 is arranged in a chamber positioned above the upper end of the cylindrical outer sleeve 21, one end of the elastic latch bar 2232 pushes against and is in contact with the latch spring 2231, and the other end of the elastic latch bart extends out of the chamber and is contacted in sliding fit with the circular arc-shaped bulge 2224 of the pressing-down locking block 2223 of the locking switch.

Further, the locking part 23 is built in the cylindrical outer sleeve 21 and comprises connecting side plates 231 and a movable lock core 232, wherein the connecting side plates 231 comprise a left connecting side plate 2311, a right connecting side plate 2312, a front connecting side plate 2313 and a rear connecting side plate 2314, the connecting side plates are mutually connected for forming a frame-shaped structure, the left connecting side plate 2311 and the right connecting side plate 2312 are correspondingly provided with special-shaped inclined holes 2315, a positioning support 2316 is arranged between the left connecting side plate 2311 and the right connecting side plate 2312 by plug-in connection, the front connecting side plate 2313 and the rear connecting side plate 2314 are correspondingly provided with square holes 2317 for enabling the pull rod 14 to penetrate, an extended block 2318 is arranged at the upper end of the front connecting side plate 2313, and a guide wedge block 2319 is arranged at the upper end of the rear connecting side plate 2314; and the movable lock core 232 is engaged and disengaged with the locking switch 222, the movable lock core 232 is arranged in the frame-shaped structure of the connecting side plates and connected in sliding fit with the special-shaped inclined holes 2315 of the left connecting side plate 2311 and the right connecting side plate 2312 through a movable bolt 2321, two ends of the movable bolt 2321 are respectively connected and matched with tension springs 2322 positioned at the left connecting side plate 2311 and the right connecting side plate 2312, the movable lock core 232 is formed by connecting and fastening a plurality of sheets 2323, and each sheet 2323 is respectively provided with clasp 2324 which can be clasped with the series of grooves on the pull rod 14. Preferably, the movable lock core 232 pushes against the extended block 2318 when the pull rod 14 is in the locking state, and pushes against the guide wedge block 2319 when the pull rod 14 is in the free state.

Figure 4A:
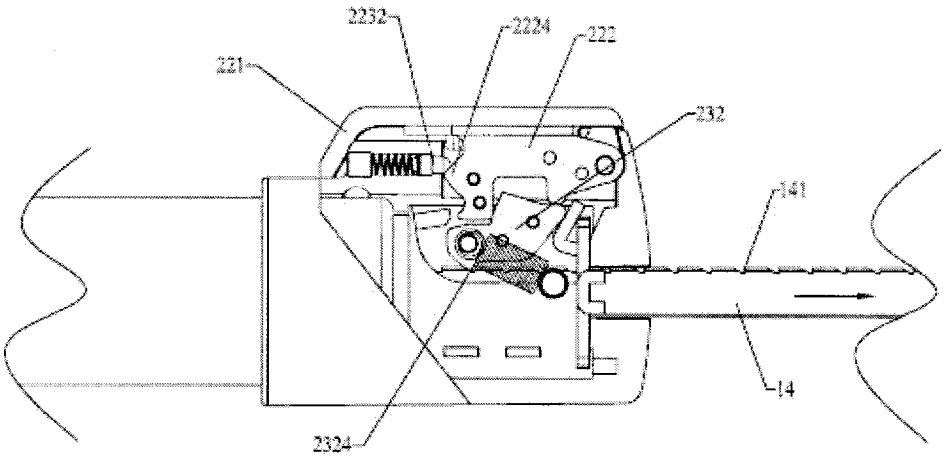
FIGS. 4*a*, 4*b* and 4*c* are schematic diagrams of using principles of the invention.

The using principles of the inventions are as follows:

As shown in FIG. 4*a*, a door leaf is pushed, then the pull rod 14 is driven to compress the long spring to extend outwards, when the door leaf needs to be stopped at a certain angle, the rotary control handle 221 is pressed down, then the rotary control handle 221 can drive the locking switch 222 to rotate and swing down, the circular arc-shaped bulge 2224 of the pressing-down locking block of the rotary control handle 221 can get across the elastic latch bar 2232 of the elastic latch component during the process of swinging down and limit its position thereby, the movable lock core 232 can simultaneously move downwards along a trajectory limited by the special-shaped inclined holes under the pressing-down action of the locking switch 222, and the clasp 2324 are sunk into the groove 141 of the pull rod 14.

Figure 4B:
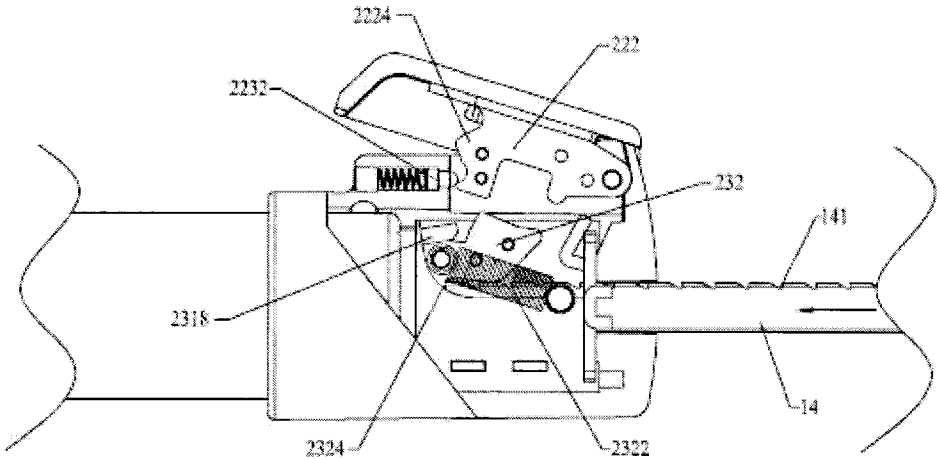
Figure 4C:
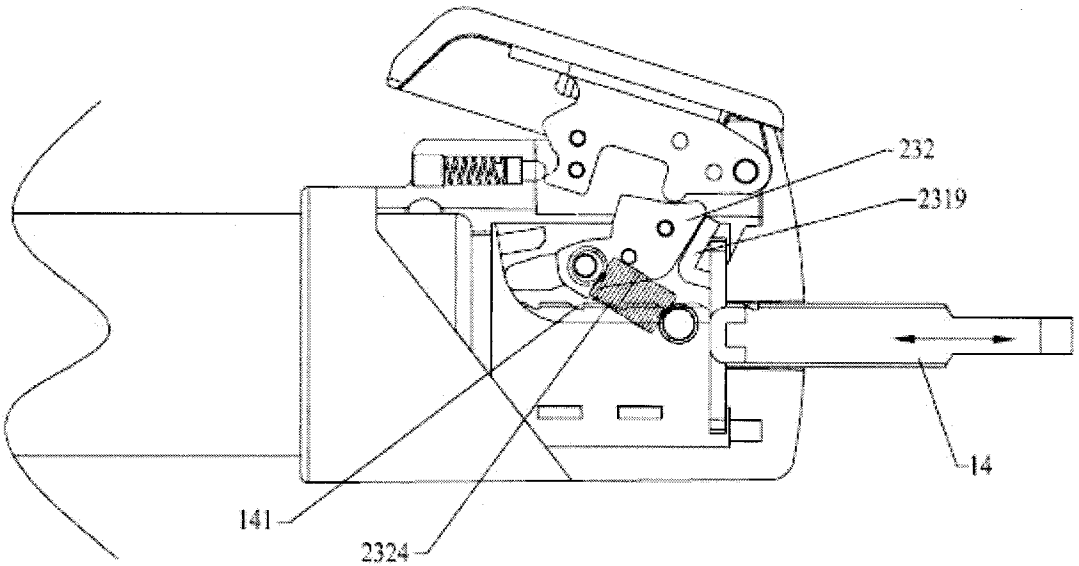

As shown in FIG. 4*b*, the door leaf is released, the pull rod 14 can retract under the action of resilience of the long spring, the vertical plane of the groove 141 can hook the clasp 2324 of the movable lock core 232, then the movable lock core 232 can be further driven against the elasticity of the tension springs 2322 and have a small displacement along the trajectory limited by the special-shaped inclined holes till being propped by the extended block 2318 of the front connecting side plate, at this time, the pull rod 14 stops the refraction and is positioned, and the door leaf is fixed at the certain angle; simultaneously, during the displacement process of the movable lock core 232, the upper end part of the movable lock core 232 can jack up the locking switch 222, then the locking switch 222 can rotate and swing up, and the circular arc-shaped bulge 2224 of the pressing-down locking block can get across the elastic latch bar 2232 and limit its position;

As shown in FIG. 4*c*, if the positioning needs to be released, only the door leaf needs to be pushed to the door opening direction and the hand needs to be released, during the process, the pull rod 14 can drive the movable lock core 232 in the door opening direction, the movable lock core 232 can simultaneously ascend along the trajectory limited by the special-shaped inclined holes under the action of the elasticity of the tension springs, and push against the guide wedge block 2319, at this time, the clasp 2324 of the movable lock core 232 can be separated from the groove 141 of the pull rod 14, then the pull rod 14 can retract freely, and the door leaf can be closed.

The invention is not limited to the above embodiments, if the changes or the derivations to the invention are not separated from the spirit and the range of the invention, and the changes and the derivations belong to the claims and the equivalent technical range, the invention also intends to include the changes and the derivations.

What is claimed is:

1. A door closer capable of realizing self-control positioning, comprising:

an elastic mechanism, wherein said elastic mechanism comprises:

a cylindrical housing, a piston component, a long spring, and a pull rod, the piston component is built in the cylindrical housing and connected and fastened with one end of said pull rod, the pull rod is sheathed in the long spring, and two end parts of said long spring respectively are in contact with a sealing lid of said piston component and said cylindrical housing; and a self-control positioning mechanism, said self-control positioning mechanism comprises:

a cylindrical outer sleeve, a control part and a locking part, the cylindrical outer sleeve is connected and fastened with the cylindrical housing, the control part is engaged and disengaged with the locking part, and the locking part is engaged and disengaged with the pull rod and clasped when locking, and said pull rod is provided with a series of grooves, wherein any one of the series of grooves is configured to be clasped with the locking part;

wherein said pull rod is in a square structure, the other end of the pull rod, which is opposite to the end fastened the piston component, penetrates the cylindrical outer sleeve and extends out of the end part of the cylindrical outer sleeve, wherein the door closer is arranged on a doorframe, and the other end of the poll rod is arranged on a door leaf, wherein the series of grooves is arranged on a top surface of the pull rod, one side wall of each groove is a vertical plane, and the opposite side wall thereof is an inclined plane;

wherein, when the door leaf is pushed, the pull rod extends outwards, and when the door leaf needs to be stopped at a certain angle, the control part is pressed down, then the control part drives the locking part to move down, and the locking part is clasped with one of the series of grooves to lock the door leaf at a certain angle;

wherein, when the door leaf is pushed in a door opening direction, the locking part separates from the groove of the pull rod, then the pull rod retracts freely, and the door leaf can be closed.

2. The door closer capable of realizing self-control positioning according to claim 1, wherein said control part comprises a rotary control handle to form a connection part, a locking switch and an elastic latch component, wherein:

said rotary control handle is arranged outside the cylindrical outer sleeve;

said locking switch is connected and joined with the rotary control handle and in rotating connection with the cylindrical outer sleeve through a movable pin, a pressing-down convex is arranged at the lower end of the locking switch, the lower end is near to the connection part, a pressing-down locking block is arranged at one end which is farther away from the connection part, and a circular arc-shaped bulge is arranged on the outer end side of the pressing-down locking block;

said elastic latch component comprises a latch spring and an elastic latch bar, the latch spring is arranged in a chamber positioned above the upper end of the cylindrical outer sleeve, one end of the elastic latch bar pushes against and is in contact with the latch spring, and the other end of the elastic latch bar extends out of said chamber and is contacted in sliding fit with the circular arc-shaped bulge of the pressing-down locking block of the locking switch.

3. The door closer capable of realizing self-control positioning according to claim 2, wherein said locking part is built in the cylindrical outer sleeve and comprises connecting side plates and a movable lock core, wherein:

said connecting side plates comprise a left connecting side plate, a right connecting side plate, a front connecting side plate and a rear connecting side plate, the connecting side plates are mutually connected for forming a frame-shaped structure, the left connecting side plate and the right connecting side plate are correspondingly provided with special-shaped inclined holes, the front connecting side plate and the rear connecting side plate are correspondingly provided with square holes for enabling the pull rod to penetrate, an extended block is arranged at the upper end of the front connecting side plate, and a guide wedge block is arranged at the upper end of the rear connecting side plate;

said movable lock core is engaged and disengaged with the locking switch, the movable lock core is arranged in the frame-shaped structure of the connecting side plates and connected in sliding fit with the special-shaped inclined holes of the left connecting side plate and the right connecting side plate through a movable bolt, two ends of the movable bolt are respectively connected and matched with tension springs positioned at the left connecting side plate and the right connecting side plate, and a clasp is arranged at the lower end of the movable lock core, which is clasped with the series of grooves on the pull rod when locking.

4. The door closer capable of realizing self-control positioning according to claim 3, wherein said movable lock core pushes against said extended block when the pull rod is in a locking state, and pushes against the guide wedge block when the pull rod is in a free state.

5. The door closer capable of realizing self-control positioning according to claim 3, wherein the movable lock core is formed by connecting and fastening a plurality of sheets, and each sheet is respectively provided with the clasp which can be clasped with any one of the series of grooves on the pull rod.

6. The door closer capable of realizing self-control positioning according to claim 3, wherein said locking part comprises a positioning support, and the positioning support is respectively fixed in plug-in manner with the left connecting side plate and the right connecting side plate.

* * * * *